US006539879B1

(12) United States Patent
Current et al.

(10) Patent No.: US 6,539,879 B1
(45) Date of Patent: Apr. 1, 2003

(54) SHELF WITH DIAMOND PATTERN RIBS

(75) Inventors: Wayne A. Current, Holmdel, NJ (US); Hal Martin, West Caldwell, NJ (US)

(73) Assignee: Garagetek, Inc., Syosset, NY (US)

( * ) Notice: Subject to any disclaimer, the term of this patent is extended or adjusted under 35 U.S.C. 154(b) by 0 days.

(21) Appl. No.: 09/393,986

(22) Filed: Sep. 10, 1999

(51) Int. Cl.[7] ..... A47B 55/00
(52) U.S. Cl. ..... 108/42; 211/153
(58) Field of Search ..... 108/27, 42, 161, 108/152, 901; 312/140.1, 140.3; 211/153

(56) References Cited

U.S. PATENT DOCUMENTS 3,669,035 A * 6/1972 Grossman ..... 108/152
4,385,565 A * 5/1983 Roberts et al. ..... 108/152
4,838,176 A * 6/1989 Bowser, Sr. et al. .... 108/901 X
5,221,013 A * 6/1993 Santucci ..... 211/153

* cited by examiner

*Primary Examiner*—John G. Weiss
*Assistant Examiner*—Michael J. Fisher
(74) *Attorney, Agent, or Firm*—Collard & Roe, P.C.

(57) ABSTRACT

A shelf system comprising a shelf plate having a length defined by a longitudinal axis and a width defined by a latitudinal axis. A series of ribs are molded into the plate on its bottom face. These ribs are offset from the longitudinal axis and the latitudinal axis so that they intersect these axes at non-right angles, preferably forming diamond shaped patterns on the underside of the shelf plate. These diamond shaped patterns are designed to increase the strength of these shelves with a minimal amount of support material.

2 Claims, 6 Drawing Sheets

SHELF WITH DIAMOND PATTERN RIBS

BACKGROUND OF THE INVENTION

1. Field of the Invention

The invention relates to a shelf that has a series of ribs molded into it. While many shelves have ribs cut or molded into them, this shelf has as series of ribs that are molded to form a diamond shaped pattern underneath a shelf surface.

2. The Prior Art

Shelves having ribs extending in a cross hatched pattern and extending along either a longitudinal axis or a latitudinal axis are known in the art. The longitudinal axis for these shelves extends along the length or longest dimension of the shelf. The latitudinal axis extends perpendicular to this longitudinal axis. These shelf designs are created to reduce the amount of material necessary for the production of the shelf without unduly limiting the strength or toughness of the shelf. However, there is a problem with the design of the prior art. Because these ribs extend along the longitudinal axis and the latitudinal axis they may reduce the strength of these shelves. These results are shown in the chart below:

Sample Test between IVC designed Shelves of the Present Invention vs. Econoco shelves of the prior art.

| Product Description: | Displacement 50 Pound Distributed Load | Displacement 50 Pound Center Load |
|---|---|---|
| Econoco Shelf (Prior Art) | .086 | 0.156 |
| IVC New Injection Molded Shelf (24" L.) | 0.046 | 0.080 |
| IVC Gas-assist Molded Shelf (24" L.) | 0.046 | 0.062 |
| IVC Extruded Shelf (24" L.) | 0.042 | 0.082 |
| Econoco Shelf (48" L) (Prior Art) | 0.662 | 1.213 |
| IVC New Injection Molded Shelf (48" L) | 0.406 | 0.668 |
| IVC Gas-assist Molded Shelf (48" L.) | 0.287 | 0.495 |
| IVC Extruded Shelf (48" L.) | 0.290 | 0.470 |

Therefore, the present invention differs from the prior art in that the design of the present invention results in much less displacement of the shelf from a weight placed on the shelf because of the diamond shaped pattern of reinforcing ribs on an under side face of the shelf

SUMMARY OF THE INVENTION

The invention relates to a shelf system comprising a shelf plate having a length defined by a longitudinal axis and a width defined by a latitudinal axis. A series of ribs are molded onto the plate wherein these ribs intersect the longitudinal axis and the latitudinal axis at an angle other than a right angle.

This series of ribs comprises a first set of ribs and a second set of ribs. The first set of ribs intersect the second set of ribs at a series of intersecting points. In this way, the first set of ribs and the second set of ribs form a series of diamond shaped patterns. This shelf system is formed from a convertible mold that comprises at least one set of inserts that permits molding various lengths of the shelves. The various inserts are arranged in the tool to mold various lengths or widths of shelves.

In addition, the first set of ribs are spaced parallel and apart from each other by at least one inch, and the second set of ribs are spaced parallel and apart from each other by at least one inch. These ribs are molded into the shelf plate. In a preferred embodiment of the invention, the shelf plate is substantially rectangular in shape and has a front end, a back end, a left end and a right end. In one embodiment of the invention, the front end has a bull nose. In another embodiment of the invention the front end has a flat face. Other nose designs can also be molded by changing a sliding insert in the tool.

These ribs are molded into the shelf plate using an injection mold. In this case, the shelf plate is injection molded together with a series of ribs. The purpose of these ribs are so that the shelf system retains or even increases its tensile strength while using less material. Thus, with this design there is great savings in material costs without a corresponding reduction in strength.

The shelf can be connected to a wall by a slatwall bracket, a gridwall bracket or by a plain shelf bracket or integral slatwall or gridwall brackets can be molded onto the various size shelves thereby eliminating the need for separate brackets.

BRIEF DESCRIPTION OF THE DRAWINGS

Other objects and features of the present invention will become apparent from the following detailed description considered in connection with the accompanying drawings which discloses several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1B:
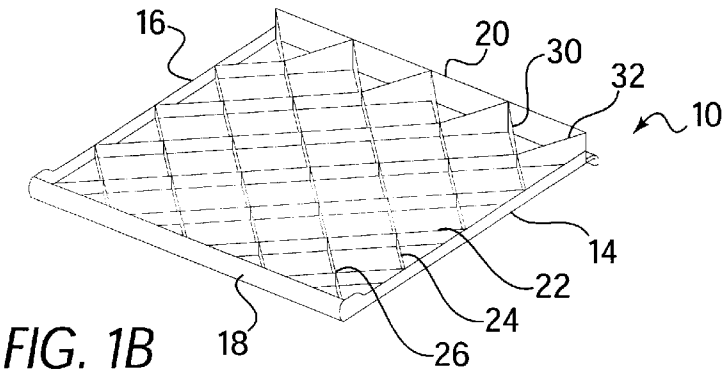
FIG. 1B shows a bottom perspective view of the first embodiment of the invention.
Figure 1A:
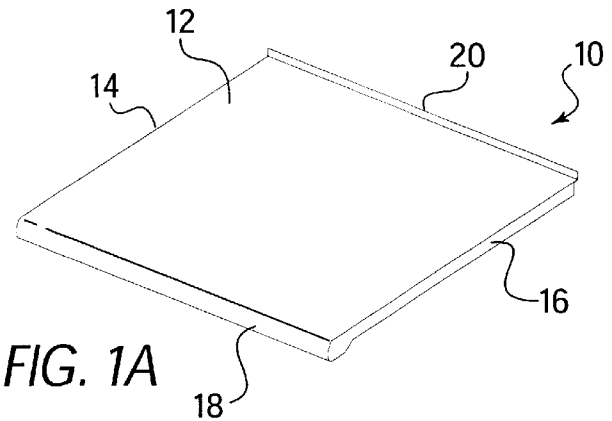
FIG. 1A shows a top perspective view of the first embodiment of the invention.

In the drawings, there is shown in FIG. 1A a first embodiment of the invention wherein a shelf plate 10 has a top surface 12, a left side surface 14, a right side surface 16, a front end surface 18 and a back end surface 20. Accordingly, FIG. 1B shows the underside portion of shelf 10 wherein, a first series of ribs 22 extend across the bottom surface accompanied by a second series of ribs 24. Ribs 22 and 24 intersect periodically at points 26. These periodic intersections create a diamond shaped pattern across bottom surface of shelf 10. Rib sections 30 and 32 increase in height to meet the bottom edge of back end surface 20, and thus have a greater height than the other sections of ribs 22 and 24. Back end surface 20 forms a gusset to support the shelf over a broader area when hooked onto a slatwall or gridwall.

Figure 2B:
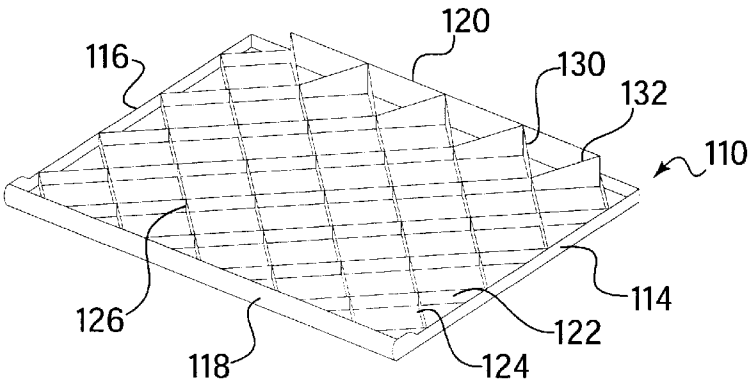
FIG. 2B shows a bottom perspective view of the second embodiment of the invention.
Figure 2A:
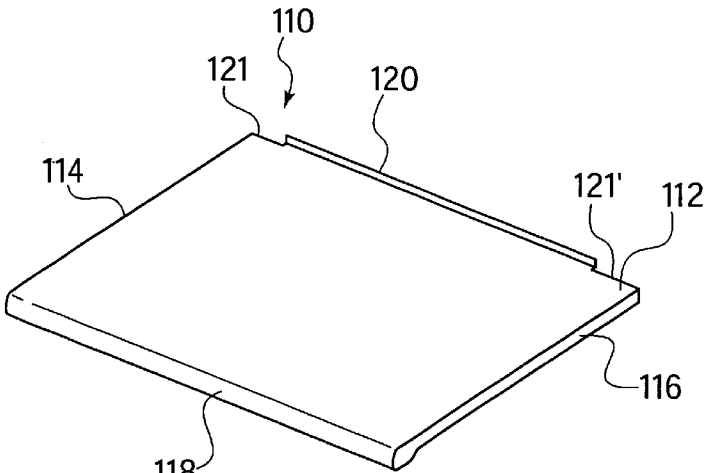
FIG. 2A shows a top perspective view of the second embodiment of the invention.

FIG. 2A shows a second embodiment of the invention. In this embodiment, shelf 110 has a greater length than shelf 10 shown in FIG. 1A. Shelf 110 contains a top surface 112 and two side surfaces 114 and 116 of similar dimensions to side surfaces 14 and 16 of shelf 10. However, front surface 118 is of a different length than front surface 18 of shelf 10. Front surface 118 extends out for a longer length than it does in shelf 10. Back surface 120 is of similar dimensions to back surface 20 of shelf 10. However, in this case, additional back surfaces 121 and 121' extend out on either side of back surface 120.

FIG. 2B shows the underside of shelf 120, wherein a series of upward sloping ribs 122 intersect a series of downward sloping ribs 124 at points 126, thus forming a diamond shaped reinforcing pattern across the bottom surface of shelf 120. Variable height rib sections 130 and 132 increase in height to meet the bottom edge of back end surface 120, and thus have a greater height than the other sections of ribs 122 and 124. Back end surface 20 forms a gusset to support the shelf over a broader area when hooked onto a slatwall or gridwall.

Figure 3B:
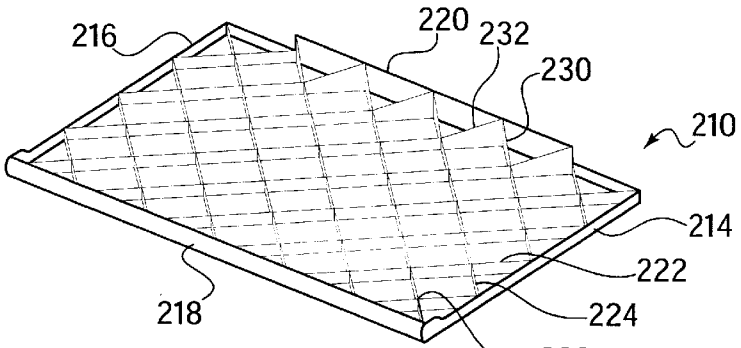
FIG. 3B shows a bottom perspective view of the third embodiment of the invention.
Figure 3A:
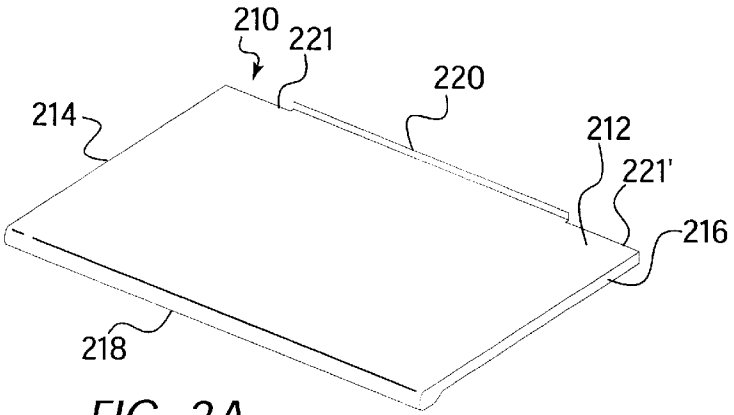
FIG. 3A shows a top perspective view of the third embodiment of the invention.

FIG. 3A is a third embodiment of the invention. In this embodiment, shelf 210 has a greater length than shelf 110 shown in FIG. 2A. Shelf 210 contains a top surface 212 and two side surfaces 214 and 216 of similar dimensions to side surfaces 14 and 16 of shelf 10. However, front surface 218 is of a different length than front surface 18 of shelf 10 and 118 of shelf 110. Front surface 218 extends out for a longer length than those in shelves 10 and 110. Back surface 220 is of similar dimensions to back surface 20 of shelf 10. However, in this case additional back surfaces 221 and 221' extend out on either side of back surface 220.

FIG. 3B shows the underside of shelf 220, wherein a series of upward sloping ribs 222 intersect a series of downward sloping ribs 224 at points 226, thus forming a diamond shaped reinforcing pattern across the bottom surface of shelf 220. Rib sections 230 and 232 increase in height to meet the bottom edge of back end surface 220, and thus have a greater height than the other sections of ribs 222 and 224.

Figure 4B:
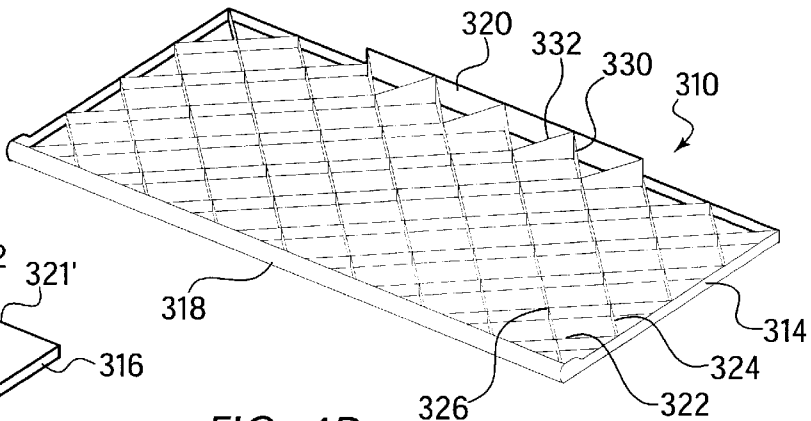
FIG. 4B shows the bottom perspective view of the fourth embodiment of the invention.
Figure 4A:
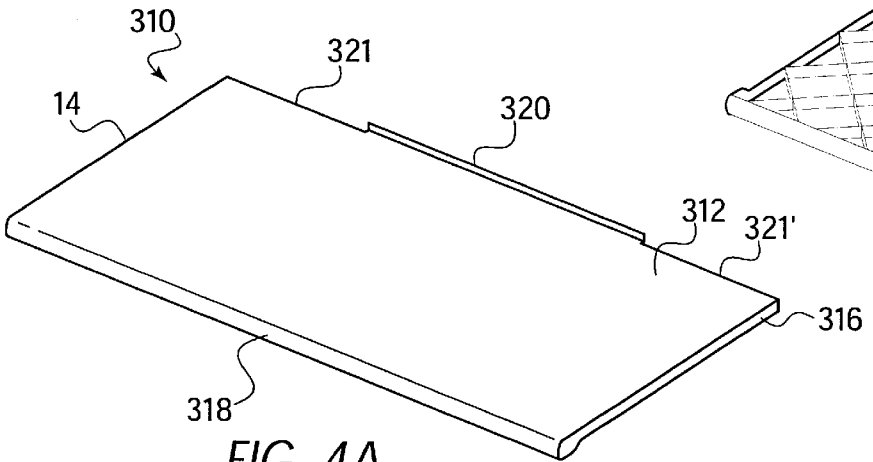
FIG. 4A shows a top perspective view of the fourth embodiment of the invention.

FIG. 4A is a fourth embodiment of the invention. In this embodiment shelf 310 has a greater length than shelf 210 shown in FIG. 3A. Shelf 310 contains a top surface 312 and two side surfaces 314 and 316 of similar dimensions to side surfaces 14 and 16 of shelf 10. However, front surface 318 is of a different length than front surface 18 of shelf 10, 118 of shelf 110, and 218 of shelf 210. Front surface 218 extends out for a longer length than in shelves 10, 110, and 210. Back surface 320 is of similar dimensions to back surface 20 of shelf 10. However, in this case, additional back surfaces 321 and 321' extend out on either side of back surface 320.

FIG. 4B shows the underside of shelf 320, wherein a series of upward sloping ribs 322 intersect a series of downward sloping ribs 324 at points 326, thus forming a diamond shaped reinforcing pattern across the bottom surface of shelf 320. Variable height rib sections 330 and 332 increase in height to meet the bottom edge of back end surface 320, and thus have a greater height than the other sections of ribs 322 and 324.

Figure 5:
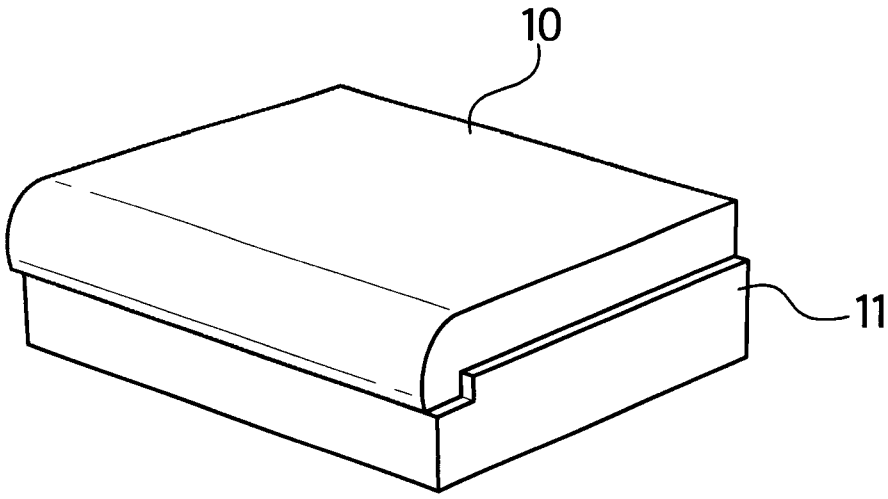
FIG. 5 shows the plate according to the invention wherein a mold piece is pressed onto the plate.

FIG. 5 shows plate 10 wherein a mold piece 11 is pressed onto the plate. This compression creates ribs 22, 24, 30 and 32 and intersection points 26 as demonstrated in FIG. 1B. As the plastic shelf material is pressed onto the mold, the soft shelf material forms in the mold. In this case, this diamond shaped pattern shown in FIGS. 1B, 2B, 3B and 4B is gas assisted injection molded.

Figure 6:
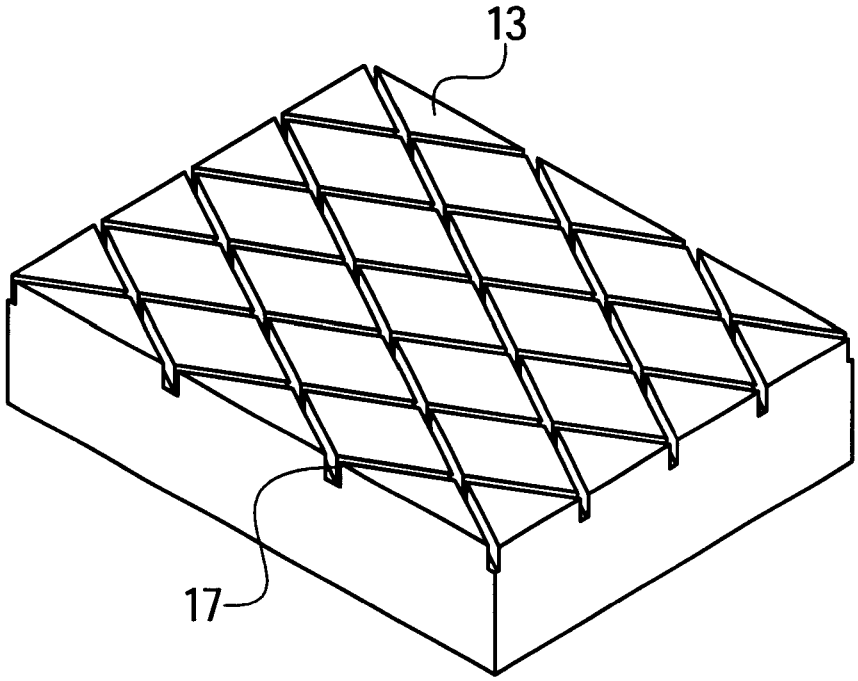
FIG. 6 shows a perspective view of the mold used to make the invention.

FIG. 6 shows a mold piece 11 used to make the invention consisting elevated diamond shaped tiers 13 separated by upward and downward sloping grooves 17. Compression with the plate creates ribs 22, 24, 30 and 32, and intersection points 26 as demonstrated in FIG. 1B.

Figure 7:
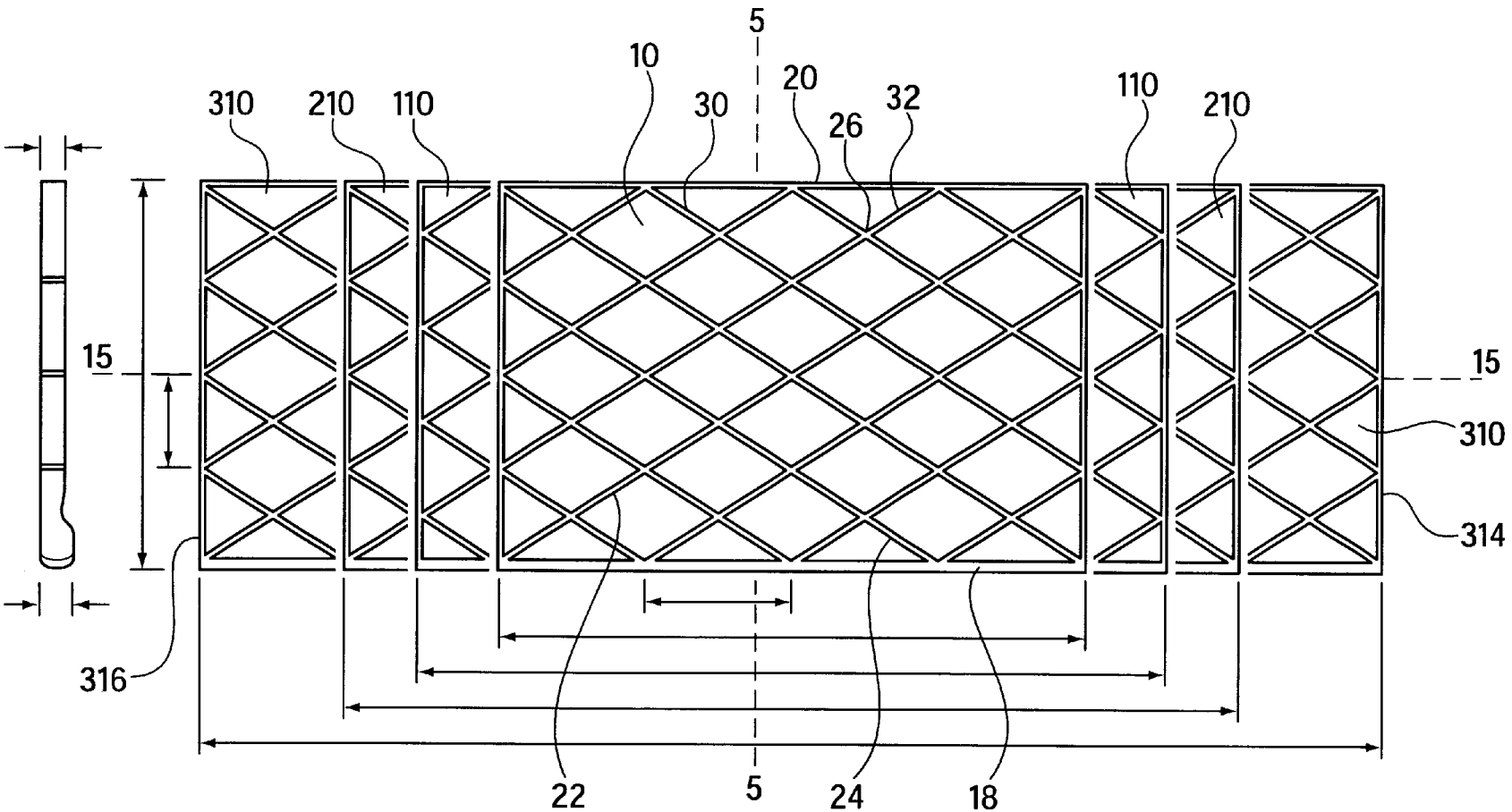
FIG. 7 shows a top view of the four different lengths of the four embodiments of the invention.

FIG. 7 shows the four different lengths of the mold plate for forming the four embodiments of the invention. Longitudinal axis 5 and lateral axis 15 extend through the plates 10, 110, 210, and 310. Rib series 22 and 24 meet at intersection points 26 and produce angles greater than 90 degrees above and below the lateral axis 15 and angles less than 90 degrees to the left and right of the longitudinal axis 5. Thus, the series of elongated diamond reinforcing structures are formed through the intersections.

Figure 8A:
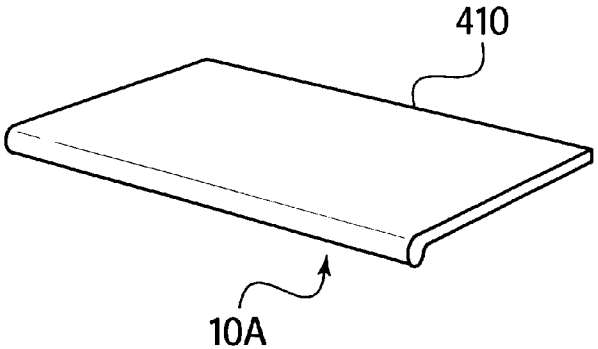
FIG. 8A shows a perspective view of a first embodiment of the invention having a bull nose which is designed to attach to a wall via brackets.
Figure 8B:
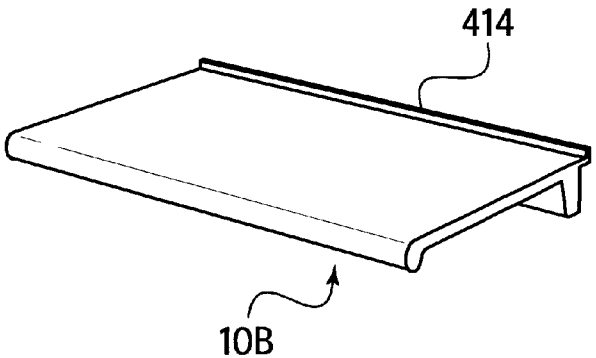
FIG. 8B shows a perspective view of a second embodiment of the invention having a bull nose designed to attach to a slatwall bracket.
Figure 8C:
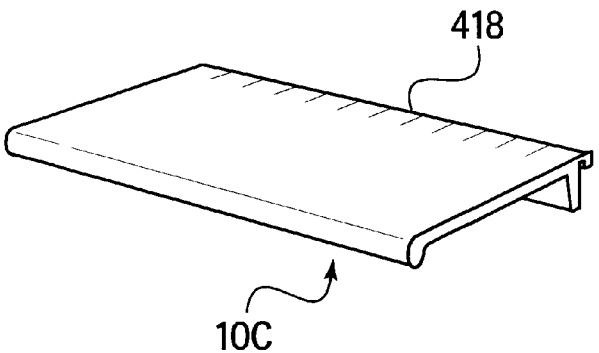
FIG. 8C shows a perspective view of a third embodiment of the invention having a bull nose and a slatwall back.

FIGS. 8A, 8B and 8C show three different embodiments for attaching shelf 10 having a bull nose to a shelf stand. For example, in FIG. 8A, shelf 10A has a flat end 410, wherein shelf 10A is designed to attach to a shelf stand or wall using standard brackets supported to the wall so that the shelf rests on top of the brake and can be bolted to shelf 10A. FIG. 8B shows a shelf 10B that has a back surface 414 that can be attached to a slatwall so that separate brackets are not necessary. Finally, FIG. 8C shows a shelf 10C having a back surface 418 designed to attach to a gridwall so that separate brackets are not necessary.

Figure 9A:
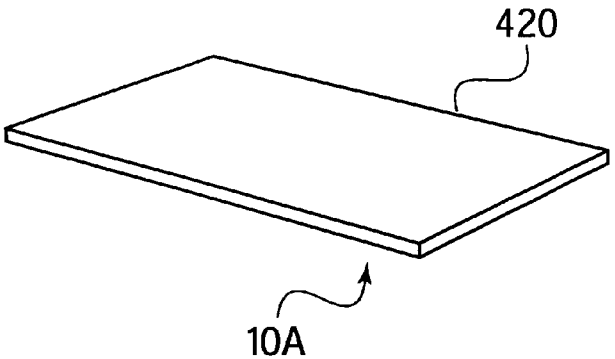
FIG. 9A shows a perspective view of the first embodiment having a flat nose.
Figure 9B:
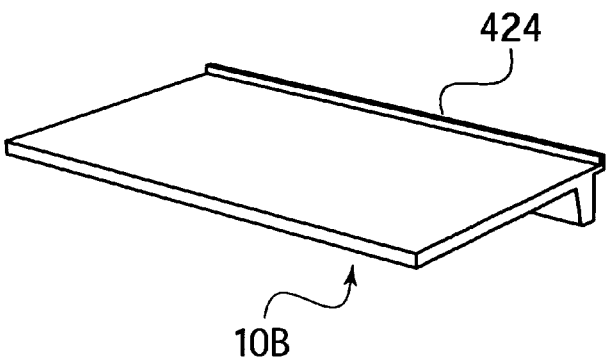
FIG. 9B shows a perspective view of the second embodiment of the invention having a flat nose.
Figure 9C:
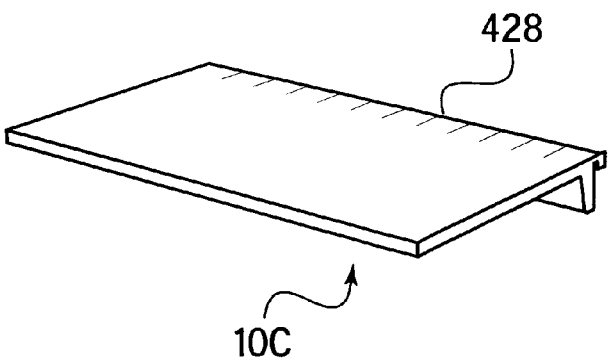
FIG. 9C shows a perspective view of the third embodiment of the invention having a flat nose.

FIGS. 9A, 9B and 9C show the corresponding different embodiments for attaching a flat-nose shelf. For example, in FIG. 9A, shelf 10A is designed to attach to a shelf stand or wall using standard brackets supported to the wall so that the shelf rests on top of the brake. FIG. 9B shows a shelf 10B that has a back surface 424 that can be attached to a slatwall. Finally, FIG. 9C shows a shelf 10C that has a back surface 418 designed to attach to a gridwall. Various nose configurations can be molded in the same tool by changing inserts.

Accordingly, while a few embodiments of the present invention have been shown and described, it is to be understood that many changes and modifications may be made thereunto without departing from the spirit and scope of the invention as defined in the appended claims.

What is claimed is:

1. A shelf system comprising:

a substantially rectangular shaped shelf plate defined by two longitudinal edges extending along a longitudinal axis of said shelf plate and two latitudinal edges extending along a latitudinal axis;

an integrally molded bracket formed as a flange extending along at least a majority portion of at least one of said two longitudinal edges, and extending substantially perpendicular to said shelf plate both above and below said shelf plate; and a plurality of ribs comprising a first set of ribs and a second set of ribs disposed on an underside of said substantially rectangular shaped shelf plate, wherein said first set of ribs and said second set of ribs periodically intersect each other to form a diamond pattern across said underside and wherein said first set of ribs and said second set of ribs increase in height from a region in front of said integrally molded bracket back to said integrally molded bracket to meet a bottom edge of said integrally molded bracket.

2. A shelf system comprising:

a substantially rectangular shaped shelf plate defined by two longitudinal edges extending along a longitudinal axis of said shelf plate and two latitudinal edges extending along a latitudinal axis;

an integrally molded bracket formed as a flange extending along at least one of said two longitudinal edges, and extending substantially perpendicular to said shelf plate both above and below said shelf plate; and a plurality of ribs comprising a first set of ribs and a second set of ribs disposed on an underside of said substantially rectangular shaped shelf plate, wherein said first set of ribs and said second set of ribs periodically intersect each other to form a diamond pattern across said underside and wherein said first set of ribs and said second set of ribs increase in height from a region in front of said integrally molded bracket back to said integrally molded bracket to meet a bottom edge of said integrally molded bracket.

* * * * *